US005088303A

United States Patent [19]

Da Costa

[11] Patent Number: 5,088,303

[45] Date of Patent: Feb. 18, 1992

[54] MIGRATION BLOCKING VALVE IN A REFRIGERATING SYSTEM

[75] Inventor: Caio Mario F. N. Da Costa, Joinville, Brazil

[73] Assignee: Empresa Brasileira De Compressores S.A. - Embraco, Joinville, Brazil

[21] Appl. No.: 491,467

[22] Filed: Mar. 8, 1990

[30] Foreign Application Priority Data

Mar. 9, 1989 [BR] Brazil ..... 8901186

[51] Int. Cl.[5] ..... F25B 41/04

[52] U.S. Cl. ..... 62/498; 62/216; 251/63

[58] Field of Search ..... 62/216, 498; 236/80 R; 251/63

[56] References Cited

U.S. PATENT DOCUMENTS

| | | | |
|---|---|---|---|
| 1,153,973 | 9/1915 | Tacit et al. | 251/63 |
| 1,516,011 | 11/1924 | Heath | 251/63 X |
| 3,004,551 | 10/1961 | Shafer | 251/63 X |
| 3,004,552 | 10/1961 | Shafer | 251/63 X |
| 3,060,699 | 10/1962 | Tilney | 62/216 X |
| 3,101,187 | 8/1963 | Campbell | 251/63 |
| 4,081,971 | 3/1978 | Eber | 62/216 |
| 4,267,702 | 5/1981 | Houk | 62/216 X |
| 4,382,370 | 5/1983 | Suefuji et al. | 62/498 X |
| 4,545,215 | 10/1985 | Inoue | 62/498 X |
| 4,622,829 | 11/1986 | Okada | 62/498 X |

FOREIGN PATENT DOCUMENTS

| | | | |
|---|---|---|---|
| 3709628 | 10/1987 | Fed. Rep. of Germany | 62/498 |
| 2121942 | 1/1984 | United Kingdom | 62/498 |
| 2121944 | 1/1984 | United Kingdom | 62/216 |

*Primary Examiner*—Henry A. Bennet
*Assistant Examiner*—Christopher B. Kilner
*Attorney, Agent, or Firm*—Darby & Darby

[57] ABSTRACT

A valve for blocking migration of refrigerant in a system including a compressor having an outlet for the compressed refrigerant and an inlet for the refrigerant to be compressed, the valve having a housing with a inlet passage for receiving the compressed refrigerant and an outlet passage, and a piston serving as the valve element which has a through passage for providing communication between the housing inlet and outlet passages when the valve is to be open. A conduit has one end in communication with the compressor case interior, and preferably with the compressor discharge muffler, and the other end with the valve housing. The valve piston is normally biased to a position to close the communication between the housing inlet and outlet passage and the refrigerant pressure when the compressor starts and is operating is conveyed through the conduit to the valve housing to move the piston to a position to open the communication between the housing inlet and outlet passages.

9 Claims, 2 Drawing Sheets

MIGRATION BLOCKING VALVE IN A REFRIGERATING SYSTEM

BACKGROUND OF THE INVENTION

This invention refers to a refrigerating fluid migration blocking valve in refrigerating systems of the type including a high side rotary hermetic compressor.

High side rotary hermetic compressors have as a working characteristic the refrigerating fluid migration every time the compressor stops from the pressurized case into the evaporator through the condenser and the refrigerating system capillary tube. Such hot fluid migration into the evaporator every time the compressor stops periodically causes some loss to the cooling capacity of the system (about 12%) since besides heating the evaporator with the hot fluid mixture, the compressor has to restore the normal working cycle every time a new start occurs, that is, to restore the regular operating pressure and temperature levels in each unit of the refrigerating system.

One present known solutions for blocking the fluid migration from the high pressure side to the low pressure side in these refrigerating systems includes employing a solenoid valve between the condenser and the capillary tube (or any other expanding element) together with a check valve which is provided on the compressor suction line. Another is employing an energy saving valve supplied by Matsushita which is provided with four connections as follows: condenser outlet line; compressor suction line; capillary tube intake; and evaporator outlet line.

These two prior art solutions are not efficient due to the high cost for the valve itself. In the case of solenoid valve, the valve itself consumes the greater part of power which should be saved by using it. In the case of the energy saving valve, its assembly in the system is expensive since it requires that the line extensions of four connections needed will be welded.

OBJECT OF THE INVENTION

The object of this invention is to provide a refrigerating fluid migration valve for small refrigerating systems without having the above mentioned drawbacks.

BRIEF DESCRIPTION

The blocking valve of this invention is applied to a refrigerating system of the type including a rotary compressor with a hermetic case provided with discharge and suction tubes or couplings (splicers). The case houses a cylinder and rolling piston assembly in communication with a discharge dampening chamber (muffler) the outlet of which is open to the case interior. There is also a refrigerating circuit coupled to the compressor and including between the discharge splicer and the suction splicer a condenser, an expanding element generally in the form of a capillary tube, an evaporator and a check valve.

According to this invention, the blocking valve in question comprises a body defining the inner chamber provided with an inlet in fluid communication with the condenser, an outlet in fluid communication with the evaporator and a driving opening in communication with the compressor discharge. A piston is housed inside the inner chamber in the valve body so that fluid communication is avoided between the valve opening for receiving the valve piston driving fluid and the inlet and outlet openings. The piston is movable between a valve opening position, allowing the fluid communication between the inlet and outlet openings in the chamber and a valve closing position blocking any fluid communication between the chamber inlet and outlet openings. The piston movement to the valve opening position is effected by the pressure differential existing between the compressor discharge and the refrigerating circuit interior at the place the valve is assembled when the compressor is to be operated. The piston movement to the valve closing position is effected when the compressor is stopped, this is effected by forces acting which constantly drives the piston to the valve closing position.

In a preferred embodiment of the invention, the blocking valve driving opening is directly connected to the discharge dampening chamber, thereby giving a short time for the valve opening. The valve manufactured in the way above described is advantageously much simpler and less expensive than those manufactured as per the prior art, and has only three connections and only one pressure intake line which generally is short.

Another advantage of the invention is that the valve is connected to the refrigerating fluid lines which are kept at similar pressure levels, thereby allowing the valve construction to be simplified in that it does not require any processing against high pressure.

BRIEF DESCRIPTION OF THE DRAWINGS

The invention will hereinafter be described with reference to the attached drawings, in which.

DETAILED DESCRIPTION OF THE INVENTION

Figure 1:
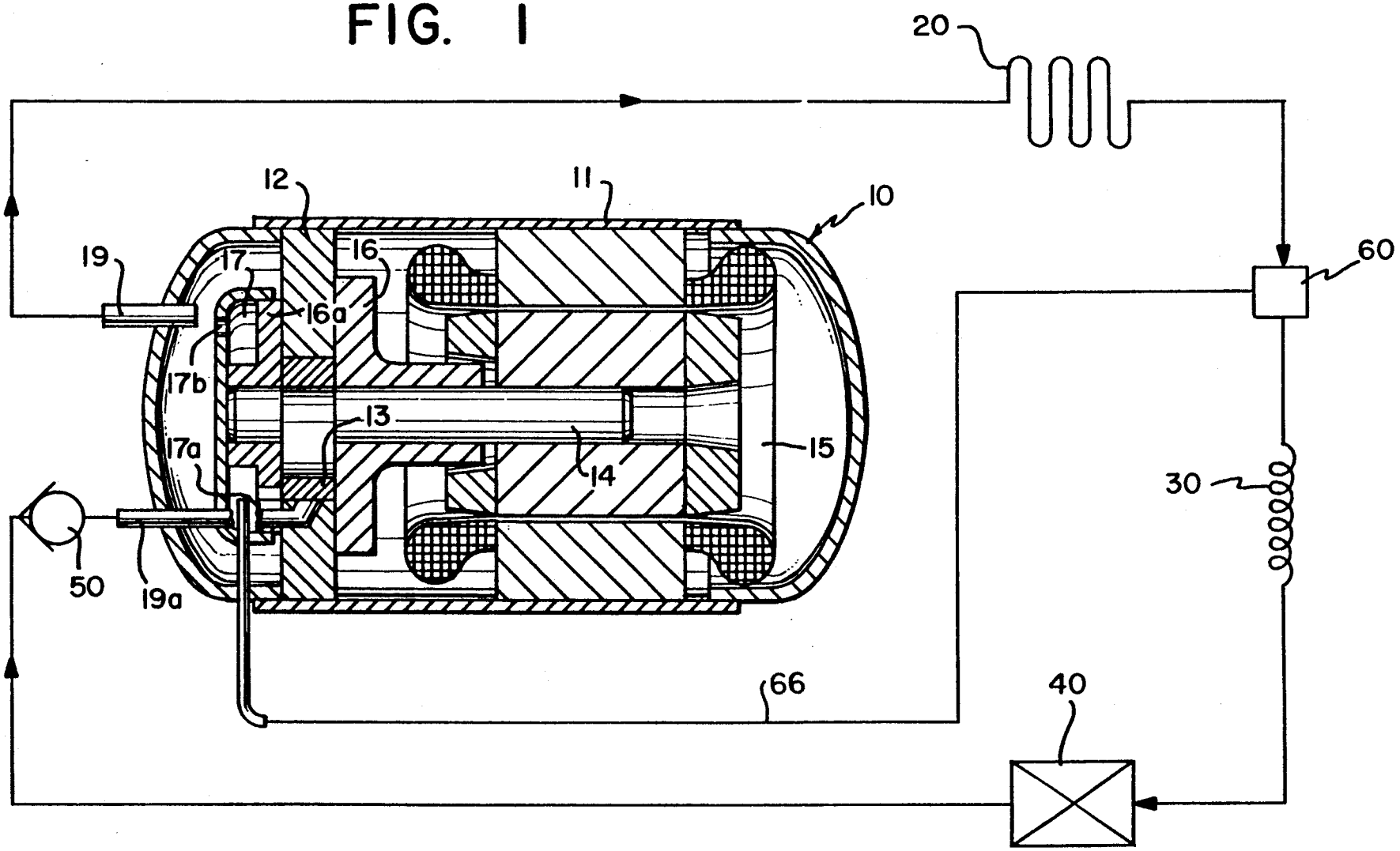
FIG. 1 is a schematic view of a refrigerating system using a migration blocking valve according to this invention.

As illustrated in FIG. 1, this refrigerating system has a hermetic compressor 10, a condenser 20, a capillary tube 30 and an evaporator 40. In systems using rotary compressors it is usual that a check valve 50 is installed between the compressor 10 and the evaporator 40. This check valve 50 functions to prevent the hot refrigerating gas within the housing to pass from the compressor 10 to the evaporator 40 each time the compressor stops.

To prevent the refrigerating gas passing from the compressor 10 to the evaporator 40 through the condenser 20 and the capillary tube 30 every time the compressor 10 stops, the system has a migration blocking valve 60 which, in the configuration illustrated in FIG. 1, is installed in the refrigerating circuit between the condenser 20 and the capillary tube 30. However, it should be understood that the migration blocking valve 60 can also be installed between the capillary tube 30 and the evaporator 40.

As illustrated in FIG. 1, the compressor 10 is of the type including a hermetic case or housing 11 which houses a cylinder 12 and a rotating piston 13 mounted on a shaft 14 driven by an electrical motor 15. An end of the shaft is supported on a main bearing 16 attached to one wall of the cylinder 12. The compressor as shown in FIG. 1 further includes a secondary bearing 16*a* attached to the other end face of the cylinder on which the discharge dampening chamber or muffler 17 is mounted.

The discharge dampening chamber 17 is adjacent to the cylinder 12 and has a gas inlet opening 17*a* in communication with the cylinder 12 discharge volume from the compression chamber and a gas outlet opening 17*b* communicating with the interior of the case 11. A discharge 19 and a suction 19*a* conduit or coupling are provided through the case end wall 11 adjacent to the discharge dampening chamber 17.

Figure 2:
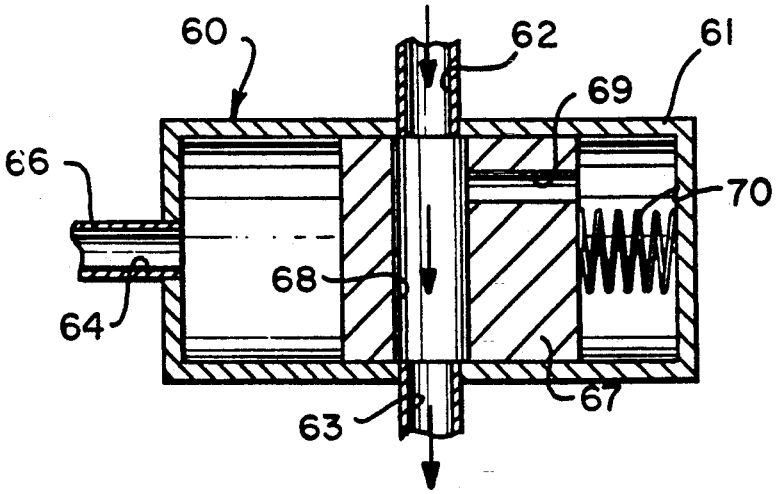
FIG. 2 shows an enlarged longitudinal sectional view of the migration blocking valve in the opening condition.
Figure 3:
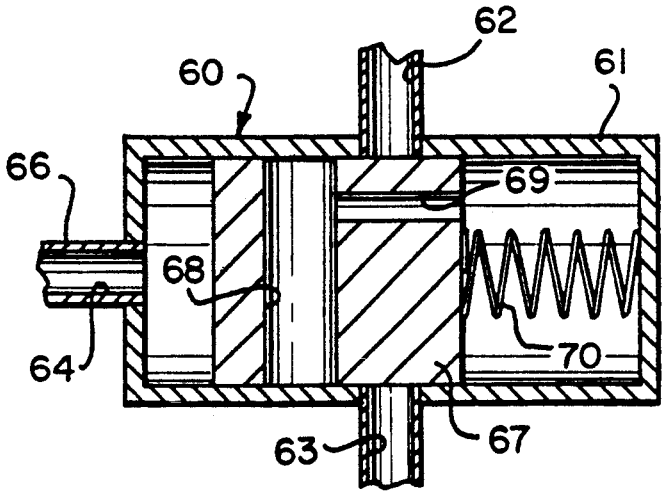
FIG. 3 shows an enlarged longitudinal section view of this migration blocking valve in the closing condition.

According to the configuration shown in FIGS. 2 and 3, the migration blocking valve 60 comprises a cylindrical housing 61 defining an inner cylindrical chamber provided with a radial lateral passage 62 for the refrigerating fluid to enter and another radial lateral and opposed passage 63 for the refrigerating gas outlet. In the configuration shown in FIG. 1, the inlet opening 62 is in direct fluid communication with the condenser outlet 20, while the outlet opening 63 is in direct fluid communication with the capillary tube inlet 30. In another embodiment, not shown, the valve 60 can be mounted between the capillary tube 30 and the evaporator 40 so that the outlet opening 63 thereof is in direct fluid communication with the evaporator 40.

The valve 60 housing 61 further includes an axial passage 64, provided on one of its ends, which receives one of the conduit 66 ends whose other end passes through the compressor case 11 and into the discharge dampening chamber 17. It should be understood that the conduit 66 communicating with the interior of the discharge dampening chamber 17 is the preferred embodiment for this invention, since that tube 66 can have its free end open to the compressor case interior 11 away from the dampening chamber 17 and, preferably, adjacent to the outlet opening 17*b* of the discharge dampening chamber. It is sufficient to say that the gas pressure from within the compressor case 61 is used to open the valve 60.

The housing end 61 opposed to that provided with axial opening 64 is hermetically closed. Inside the housing 61 a cylindrical piston 67 is mounted, which has a transverse passage 68. Piston 67 permits fluid communication between the inlet 62 and outlet 63 openings when the piston 67 is moved to its valve opening position as shown in FIG. 2, and the transverse passage 68 is kept in fluid communication with the piston end opposed to that adjacent to the driving opening 64, at least through an axial passage 69. The piston 67 and the housing 61 are sized that, in the valve closing position (see FIG. 3), the fluid communication between the inlet 62 and outlet 63 passages will be fully blocked.

The valve 60 constructive configuration and, more particularly, the piston 67 shown in FIGS. 2 and 3 is only given by way of example. Piston 67 can also have other geometric shapes that in the valve opening position allows a fluid communication between the inlet 62 and outlet 63 openings and in closed valve condition blocks the fluid communication.

The piston axial passage 69 is between passage 68 and the face opposite that receiving the refrigerant pressure from the passage 64. This provides fluid communication between the end wall of the housing opposite to the passage 64 and the piston when the valve is in "open" condition. This bleeds off some of the fluid moving through piston passage 68 to act to move the piston to the closed position. This aids in rapid closing of the valve when the compressor stops.

Also according to the embodiment shown in FIGS. 2 and 3, the blocking valve further includes a spring 70 mounted inside the chamber between the piston 67 face opposed to the closed end of the housing and the housing closed end. Spring 70 is sized to work as a backstop, thereby limiting the piston 67 movement in the "open" (FIG. 2) valve position and constantly urging the piston 67 to the closed valve position every time the compressor stops. The spring 70 applies to piston 67 a constant axial force for the opening of the valve which is lower than the axial force for the closing of the valve which is caused by the differential pressure between the interior of the discharge dampening chamber 17 and the interior of the inlet 62 and the outlet 63 openings in the valve 60.

Figure 4:
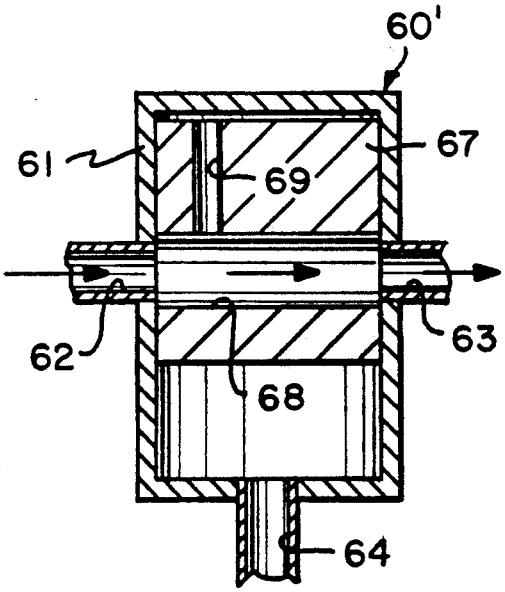
FIGS. 4 and 5 are views similar to FIGS. 2 and 3, respectively, of an alternative embodiment of the invention.
Figure 5:
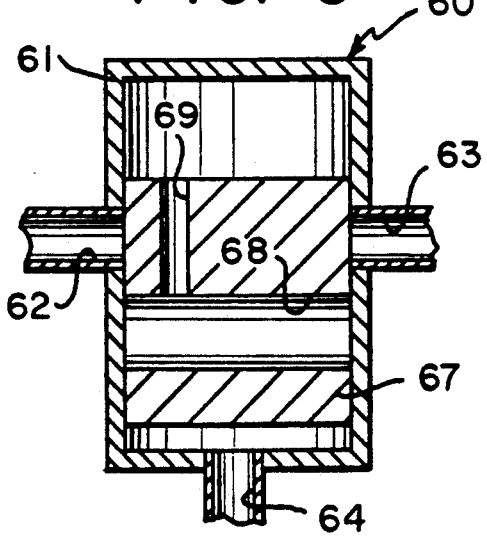

It should be understood that the spring 70 is only one way to construct the valve. Such spring can be eliminated so that the piston closing force will be the gravity force itself acting on the piston 67. This is illustrated in the valve 60' (FIGS. 4, 5) where corresponding parts have the same reference numerals as in FIGS. 2, 3.

The operation of valve 60 as shown in FIGS. 2 and 3 is as follows. When the compressor 10 starts operating, the pressure inside the case 11 and, more particularly, inside the discharge dampening chamber 17, quickly rises and is conveyed by the tube 66 to the valve axial opening 64 into the valve housing. This causes the piston 67 to move to the valve opening position as where there is fluid communication between the inlet 62 and the outlet 63 passages, shown in FIG. 2. The spring 70 is compressed. The conduit 66 from the compressor to the valve is sized to cause the pressure inside the valve 60 at the driving passage 64 when the compressor 10 is operated, to be higher than the refrigerant pressure at the inlet opening 62 area. This permits the piston 67 to be moved to the open valve position, and the spring 70 be compressed.

When the compressor is switched off, the overpressure inside the valve housing 61 stops acting at the driving passage 64. This causes the driving pressure to be equal to the pressure at the inlet opening 62 area and allows the piston 67 to be moved to the closed valve position by the action of spring 70 acting as in the illustrated configuration.

Although only a possible configuration for the migration blocking valve has been herein described and illustrated, it should be understood that modifications can be made within the inventive principle as defined in the following claims.

What is claimed is:

1. A refrigerant fluid migration blocking valve for a refrigeration system having in operation a low pressure side and a high pressure side, said system including a compressor in a case, said compressor having a discharge outlet for a compressed refrigerant and in inlet for a refrigerant to be compressed, said valve comprising:

a valve housing having a cylindrical chamber therein with first and second opposed ends and an inlet for said compressed refrigerant to enter said chamber, and an outlet from said chamber for said compressed refrigerant, said first chamber end being closed;

a piston positioned within said chamber, said piston sealingly and slidingly separating said chamber ends, said piston having a first passage therethrough, in a first position of said piston said piston blocking refrigerant flow from said inlet to said outlet, in a second position of said piston said first passage aligning with said inlet and said outlet to permit refrigerant flow through said valve housing, a second passage in said piston connecting said first passage to a portion of said chamber between said piston and said first chamber end;

means for connection to the high pressure side of said refrigerant system for moving said piston from said first position to said second position when said system changes from an inoperative to an operative state, and from said second position to said first position when said system changes from an operative to an inoperative state.

2. A refrigerant fluid migration blocking valve as in claim 1, wherein said means for connection is a refrigerant line inlet, said line inlet opening into a portion of said chamber between said piston and said second chamber end and entering below said piston.

3. A refrigerant fluid migration blocking valve for a refrigeration system having in operation a low pressure side and a high pressure side, said system including a compressor in a case, said compressor having a discharge outlet for a compressed refrigerant and an inlet for a refrigerant to be compressed, said valve comprising:

a valve housing having a cylindrical chamber therein with first and second opposed ends and an inlet for said compressed refrigerant to enter said chamber, and an outlet from said chamber for said compressed refrigerant, said first chamber end being closed;

a piston positioned within said chamber, said piston sealingly and slidingly separating said chamber ends, said piston having a first passage therethrough, in a first position of said piston said piston blocking refrigerant flow from said inlet to said outlet, in a second position of said piston said first passage aligning with said inlet and said outlet to permit refrigerant flow through said valve housing, a second passage in said piston connecting said first passage to the portion of said chamber between said piston and said first chamber end;

spring means within said chamber between said piston and said first chamber end for urging said piston toward said first position;

a high pressure inlet to the portion of said chamber between said piston and said second chamber end, said inlet being for connection to the high pressure side of said refrigerant system;

said spring generating a force able to drive said piston to said first position when said compressor is inoperative in providing high pressure at said high pressure inlet, when said compressor operates said high pressure inlet admitting pressurized refrigerant to said chamber to drive said piston to said second position.

4. A blocking valve as in claim 3, wherein said valve housing includes a cylindrical wall defining said chamber between said chamber ends, said valve housing inlet and said valve housing outlet being on said cylindrical wall.

5. A valve as in claim 4, wherein said inlet and said outlet are diametrically positioned on said cylindrical chamber wall.

6. A valve as in claim 4, wherein said first passage passes radially through said piston.

7. A refrigerant fluid migration blocking valve for a refrigeration system having in operation a low pressure side and a high pressure side, said system including a compressor in a case, said compressor having a discharge outlet for a compressed refrigerant and an inlet for a refrigerant to be compressed, said valve comprising:

a valve housing having a cylindrical chamber therein with first and second opposed ends and an inlet for said compressed refrigerant to enter said chamber, and an outlet from said chamber for said compressed refrigerant, said first chamber end being closed;

a piston positioned within said chamber, said piston sealingly and slidingly separating said chamber ends, said piston having a first passage therethrough, in a first position of said piston said piston blocking refrigerant flow from said inlet to said outlet, in a second position of said piston said first passage aligning with said inlet and said outlet to permit refrigerant flow through said valve housing, a second passage in said piston connecting said first passage to the portion of said chamber between said piston and said first chamber end;

a high pressure inlet to the portion of said chamber between said piston and said second chamber end, said inlet being for connection to the high pressure side of said refrigerant system;

said piston having a weight to drive said piston by gravity to said first position when said piston is oriented for non-horizontal sliding and said compressor is inoperative in providing high pressure at said high pressure inlet, when said compressor operates said high pressure inlet admitting pressurized refrigerant to said chamber to drive said piston to said second position.

8. A combination of said valve as in claim 3 with said compressor, said compressor discharge outlet being connected to said high pressure inlet to said chamber between said piston and said second chamber end, said compressor case including a muffler chamber for receiving compressed refrigerant from said compressor and delivering said refrigerant to said discharge outlet.

9. A combination as in claim 8, wherein said discharge outlet extends into the interior of said muffler chamber.

* * * * *